United States Patent [19]

Ollerman

[11] 4,237,563

[45] Dec. 9, 1980

[54] LIVING MODULE FOR INSTITUTIONAL RESIDENTS

[76] Inventor: Thomas E. Ollerman, 4511 E. Belleview St. #2, Phoenix, Ariz. 85008

[21] Appl. No.: 9,937

[22] Filed: Feb. 7, 1979

[51] Int. Cl.[3] ..... A47B 83/00; A61G 7/00

[52] U.S. Cl. ..... 5/2 R; 5/8; 5/9

[58] Field of Search ..... 5/2 R, 4, 5, 8, 9; 52/27, 28, 34, 36, 173; 128/1, 172

[56] References Cited

U.S. PATENT DOCUMENTS

| | | | |
|---|---|---|---|
| 3,338,648 | 8/1967 | Bannister | 5/8 |
| 3,950,796 | 4/1976 | Hollingsworth | 5/2 R |
| 4,109,328 | 8/1978 | Mason | 5/2 R |
| 4,139,916 | 2/1979 | Alford, Sr. | 5/2 R |

*Primary Examiner*—Casmir A. Nunberg

*Attorney, Agent, or Firm*—Cahill, Sutton & Thomas

[57] ABSTRACT

A module for residents under institutional care includes a bed unit having a high side panel and high end panels to ensure a reasonable degree of privacy and also includes a theft-proof tall storage unit. The storage unit has a lockable door, overhead storage space, a plurality of internal shelves, an internal support surface, an internal drawer, and an extendible desk in it which can be extended exteriorally of the tall storage unit or slid into the side of the storage unit and locked therein. The desk unit includes a hingeable top surface attached to an underlying storage compartment and a lock which prevents the desk unit from being extended toward the bed unit unless unlocked from within the storage unit. The extended desk unit is disposed at a height such that there is adequate knee space beneath the bottom of the storage compartment and the top of the bed so that a resident can conveniently sit on the edge of the bed and utilize the desk unit for studying. The entire module, including the bed and the storage unit, is assembled from a plurality of pre-cut, pre-drilled and pre-grooved wooden beams and uprights, a plurality of pre-cut wooden panels which fit into the grooves, and a plurality of bolts and nuts. The module provides a sturdy home territoriality module which provides theft-proof storage for personal property of the resident. Residents, especially adolescent residents of an institution can, with supervision, assemble their own modules as part of a behavior modification program wherein portions of the module are earned by socially appropriate behavior.

11 Claims, 6 Drawing Figures

LIVING MODULE FOR INSTITUTIONAL RESIDENTS

BACKGROUND OF THE INVENTION

1. Field of the Invention

The invention relates to personal living modules for sleeping, studying, and storage of personal possessions for institutional residents, and more particularly, to modules which are easily assembleable by adolescent residents as part of a behavior modification program.

2. Description of the Prior Art

A variety of problems are consistently encountered by institutional personnel and therapists in the course of caring for residents of child residential treatment centers, adolescent group homes, reform schools, and the like. Some of these problems are due to the institutional environment, especially to the type and poor quality of facilities ordinarily available to the residents. Consequently, residents frequently complain that they do not identify with the facility or personnel because of a pervasive "institutional atmosphere". This results from the lack of privacy, and lack of efficient, theft-proof storage space for personal possessions, and sterile, shabby appearance of the living facilities. As a result, the residents frequently feel imprisoned, and become increasingly alienated to both the institution and its personnel and therefore fail to obtain benefits of treatment at the institution, which benefits might otherwise be received and responded to by the residents. Lack of personal storage space results in frequent theft of personal possessions of residents, causing further frustration of those who lose their few personal possessions, and further negatively affecting their general attitude and their receptiveness and responsiveness to treatment. Frequently, the facilities of the above institutions include government issued facilities, such as metal army type cots and foot lockers, and unattractive and uncomfortable bedding. Donated furniture from the community is frequently available to such institutions, but is usually in very poor condition, and is usually unattractive and not at all suitably designed for institutional use. Private closet space and locked individual storage space of any type is often completely unavailable. A large number of such beds are commonly placed in a single room, and the residents have absolutely no privacy and no opportunity to be alone. At best, the residents achieve substantially less benefit from the treatment offered by the institution than they would receive if better facilities were available, and at worst, their condition deteriorates rather than improves during their stay in the institution. Further, proper maintenance costs are usually very high at the above institutions due to the destructive acts of residents who are highly alienated toward the institution and its facilities.

Accordingly, it is an object of the invention to provide personal living modules for institutional residents which provide a reasonable degree of privacy for each resident.

Another object of the invention is to provide personal modules for institutional adolescent residents which reduce maintenance costs.

Still another object of the invention is to provide personal modules for residents which reduce the institutional atmosphere and reduce residents' alienation toward facilities and personnel of the institution.

Certain types of heavy, wooden bunk-type modules are know, having a high bed, a ladder with dowel-type rungs, and a chest of built-in drawers beneath the bed supporting one end of the bed and a desk surface supported between the chest of drawers and an end support supporting the opposite end of the bed. However, such modules are quite unsuitable for use in child residence treatment centers and adolescent group homes, etc., due to the fact that the large amount of drawer space is largely unused (because residents usually have very few personal possessions) and the drawers are not sufficiently large to store certain kinds of equipment, such as sporting equipment, which is highly valued by children or adolescent residents. The drawers are not lockable by a single key, a separate chair is required for the desk, and the raised bed portion is unsafe and affords very little privacy. The ladders are unsafe because they can be disassembled and utilized by weapons by emotionally disturbed residents. In short, the foregoing module, although possibly quite attractive for use in childrens' rooms in private homes, does not meet the needs of the above institutions. Further, modules of the foregoing design are quite expensive.

Accordingly, yet another object of the invention is to provide a safe, theft-proof, personal living module of relatively low cost which does not have small removable components which can be destructively deployed by adolescent residents.

SUMMARY OF THE INVENTION

Briefly described, and in accordance with one embodiment thereof, the invention provides a personal living module for institutional residents. The module includes a bed unit having a high side panel and high opposed end panels, and also includes a separate theft-proof storage unit including a desk unit which is extendible from and is also returnable and lockable into an opening in a first wall of a storage unit. The bed unit has four high corner posts each having one or two grooves into which the respective side edges of the side panel and end panels are fitted. The bed unit further includes lower and upper horizontal panel support members or beams positioned between and bolted to respective ones of the corner posts. The lower and upper horizontal panel support members each have a groove into which the respective bottom and top edges of the side panel and end panels are fitted and retained. An overhead storage shelf is supported by the upper panel support members. Horizontal beams bolted to and extending between respective ones of the corner posts support a rigid mattress support plate. A standard sized mattress is positioned on the mattress support plate. The storage unit is of substantially the same height as the bed unit. The desk unit is supported by a pair of sliding guides mounted on the interior of the storage unit so that the desk unit can be pulled outward of the opening in the first wall along the sliding guides to a predetermined distance and is supported at a height selected to provide adequate knee space while a resident sits on the edge of the bed to work or study at the extended desk unit. The storage unit has a door having an outer lockable knob and an inner knob which is not lockable to prevent anyone from being trapped within the storage unit. A bench or support surface inside the storage unit is attached to the first wall, under which support surface the desk unit is positioned when it is in its returned position. A lock which is only unlockable from within the storage unit can be activated to lock the desk unit in the return position. A drawer which can be pulled outwardly through the open door of the storage unit is positioned beneath the desk unit (when it is in the returned position). A storage space for bulky items is provided between an end support of the bench or support surface beneath the bottom of the drawer. A plurality of shelves are attached to the first wall above the bench or support surface. A vertical storage space for long items is provided between the end support and a second wall of the storage unit and extends from the floor to the ceiling of the storage unit.

The desk unit includes a drawer-like compartment with a hingeable top which serves as the desk top surface. The top of the storage unit extends a predetermined distance over the desk unit when it is extended. A light unit is attached to the extending portion of the top, which also serves as a shelf on which decorative items or the like may be placed or stored. A pair of movable side curtains or shades optionally are hung from the opposed sides of the extended portion of the top to provide a privacy region.

The storage unit includes four vertical corner posts, each having one or two grooves for receiving side panels. The storage unit also includes lower and upper horizontal beams extended between and bolted to the respective lower and upper ends of the corner posts. The horizontal upper and lower members include grooves for receiving wall panels of the storage unit, the bottom or floor panel thereof, and a top or ceiling panel thereof. The corner posts and panels are made of wood.

The personal living module may be shipped as a kit assembleable without glue by use of bolts to provide a durable, easily maintained home territoriality module. Child and adolescent residents of an institution can take part in assembly of the personal living module kit as a part of a behavior modification program, giving such residents an opportunity to develop construction skills, obtain beneficial interaction with therapy personnel, and achieve a sense of personal pride and ownership in and respect for their living quarters and furnishings. Such residents can also finish and decorate the surfaces of the module to suit their own tastes, furthering the sense of pride in their living environment and furthering their sense of personal accomplishment.

BREIF DESCRIPTION OF THE DRAWINGS

DESCRIPTION OF THE INVENTION

Figure 1:
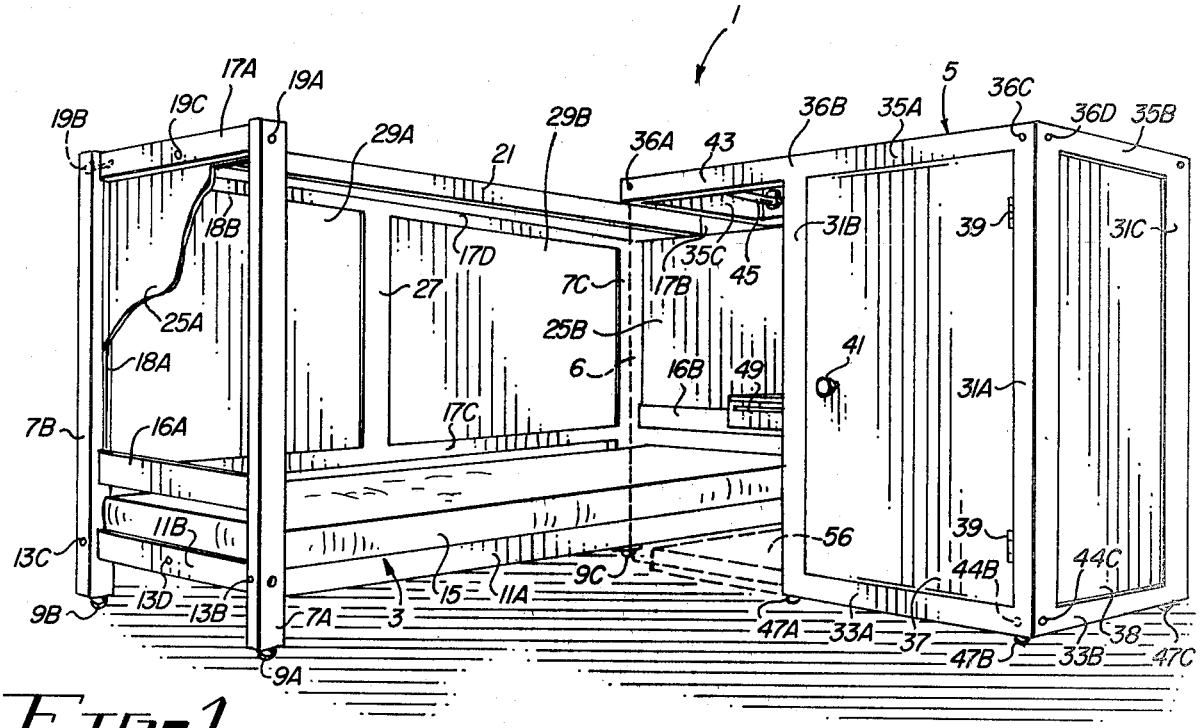
FIG. 1 is a perspective view of the personal living module of the invention.

Referring now to the drawings, and particularly to FIG. 1, personal living module 1, hereinafter referred to as module 1, includes a bed unit 3 and a storage unit 5. Bed unit 3 and storage unit 5 are separate units which are ordinarily unattached to each other, but which may be connected to each other if desired. As explained below, storage unit 5 is constructed so as to be theft-proof, since theft of personal possessions is a common problem in child residential treatment centers, adolescent group homes, and the like. An extendible and retractable or returnable desk unit 49 is normally in its "storage" position within an opening 98 (FIG. 3) on the left side of storage unit 5. Desk unit 5 can be unlocked from its storage position within storage unit 5 and extended outward for use, as shown in FIG. 1.

Storage unit 5 can be positioned relative to bed unit 3, as shown in FIG. 1, so that a resident of the institution can sit on the edge of mattress 15 of bed unit 3 immediately in front of extended desk unit 49. A curtain 6, shown in dotted lines in FIG. 1, can be drawn to provide privacy for a resident seated in front of desk unit 49. Bed unit 3 is mounted on lock-type casters such as 9A, 9B, and 9C. Similarly, storage unit 5 is mounted on lock-type casters such as 47A, 47B, and 47C, if desired. This facilitates moving of module 1 to ease cleaning of the floor by institution personnel, thereby reducing institution costs.

Bed unit 3 includes four vertical corner posts which are each approximately sixty-six inches high and are constructed of high quality pine wood "two-by-fours". (Pine wood is especially suitable for all of the vertical posts and horizontal beams in both bed unit 3 and storage unit 5.) As subsequently explained, the corner posts and certain ones of the horizontal beams have one or two grooves therein for receiving the respective edges of end panels or side panels of the bed unit 3 or wall panels or a roof panel of storage unit 5.

Figure 2:
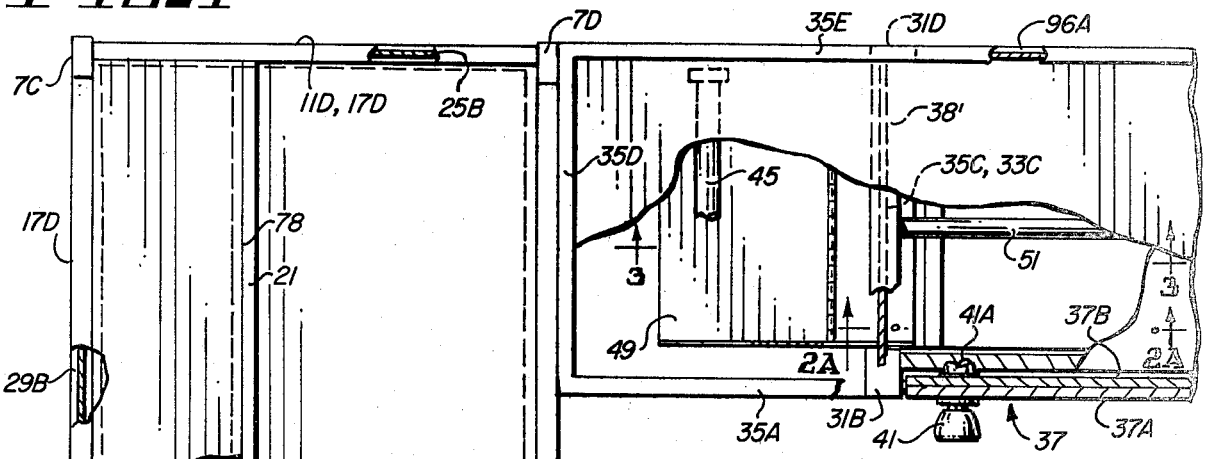
FIG. 2 is a partial cut away top view of the personal living module of FIG. 1.
Figure 2A:
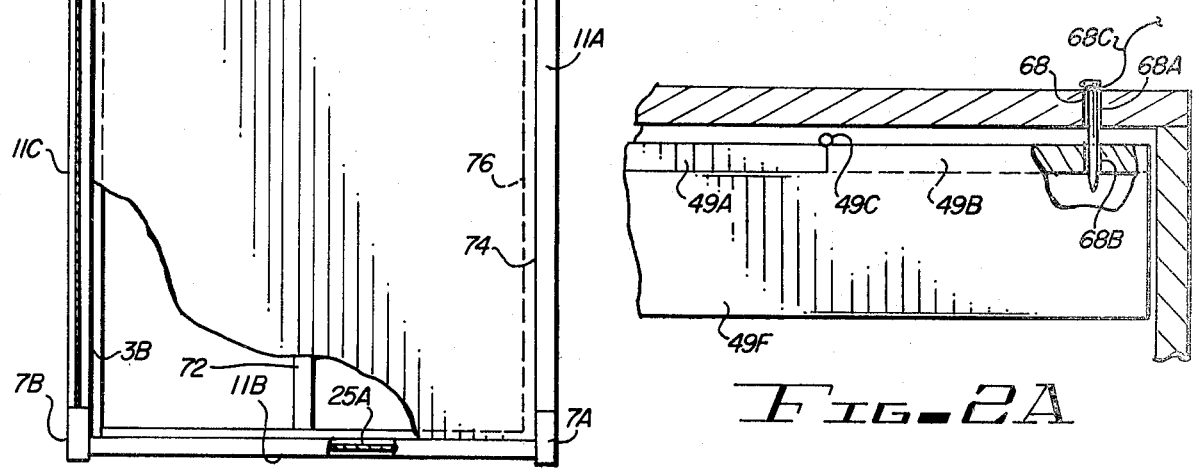
FIG. 2A is a partial sectional view taken along section lines 2A—2A of FIG. 2.

Referring to FIGS. 1 and 2, bed unit 15 includes a pair of side beams such as 11A and 11C, the ends of which are bolted to corner posts 7A, 7B, 7C and 7D, respectively. Bed unit 3 also includes a pair of end beams or rails 11B and 11D, ends of which are also bolted to the appropriate corner posts. For example, end rail 11B is bolted by means of bolt 13A to corner post 7A and by means of another bolt (not shown) to corner post 7B. Similarly, side rail 11A is bolted by means of bolt 13B to corner post 7A. The pair of side rails (11A and 11C) and end rails (11B and 11D) support a mattress support panel or plate 76, shown in FIG. 2, by means of a corner notch 74 in side rail 11A and corresponding corner notches in rails 11B, 11C, and 11D, as shown in FIG. 2. A center rail 72, shown in FIG. 2, extends between end rails 11B and 11D to provide additional support for mattress support panel 76. Center rail 72 is bolted to end rail 11B by means of bolt 13D, shown in FIG. 1, and is similarly bolted to end rail 11D. A standard twin size mattress 15 is supported on support board 76, as shown in FIG. 1.

An end panel 25A is supported between end posts 7A and 7B. Similarly, end panel 25B is supported between end posts 7C and 7D (FIG. 2). A pair of side panels 29A and 29B are supported between end posts 7B and 7C, as subsequently explained.

For example, end panel 25A consists of a piece of quarter inch thick plywood, the respective edges of which extend snugly into longitudinal grooves, such as grooves 18A and 18B, of upper beam or rail 17A and lower beam or rail 16A, both of which are bolted to corner post 17A by means of bolts 19A and 19D, respectively. The opposite ends of lower panel support beam 16A and upper panel support beam 17A are bolted to corner post 7B. End panel 25A has its respective vertical edges snugly fitted into corresponding grooves of the inner surfaces of end posts 7A and 7B. End panel 25B is similarly supported at the opposite end of bed unit 3. The lower edges of panel support beams 16A and 16B are positioned a sufficient distance above the top of mattress 15 to permit easy "making" of the bed by tucking sheets, blankets and the like under the edges of mattress 15 without interference by beams 16A and 16B. Beam 17C has its lower edge similarly positioned above the top of mattress 15.

Still referring to FIGS. 1 and 2, side panels 29A and 29B are supported similarly to end panels 25A and 25B. For example, side panel 29B is supported by lower and upper horizontal "two-by-four" beams 17C and 17D, respectively, each having elongated quarter inch wide grooves into which the upper and lower edges of side panel 29B are snugly fitted. The side edges of side panel 29B fit into quarter inch wide grooves of center post 27, which is a "two-by-four" extending between horizontal member 17C and 17D, respectively, and a quarter inch wide groove in corner post 7C. Horizontal beams 17C and 17D have dadoed holes therein (not shown) for receiving tongues extending from the upper and lower ends of center post 27 into the dadoed holes so that no bolts are required to fasten center post 27 to horizontal beams 17C and 17D.

Figure 4:
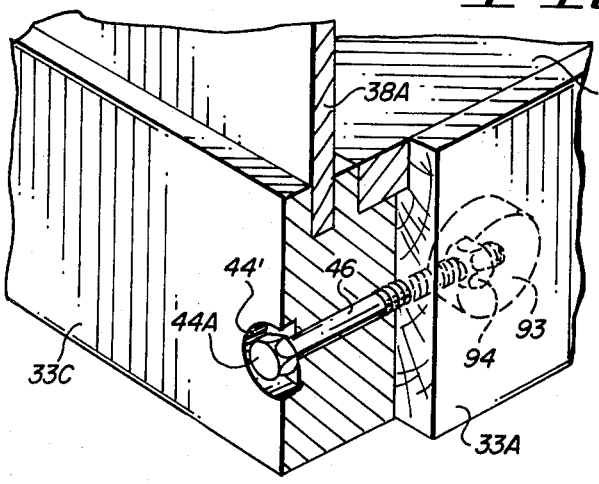
FIG. 4 is a perspective partial cut away view useful in describing the construction of the personal module of FIG. 1.

All of the bolts, such as 13A–13D, 19A–19C, etc. of bed unit 3 and all of the bolts such as 44A–44C, 36A–36D, of storage unit 5 are utilized as shown in the example corner joint of FIG. 4. At this point, it will be helpful to describe FIG. 4 in detail. Referring now to FIG. 4, beam 33C is joined to beam 33A by means of bolt 44A. Bolt 44A extends through a lateral hole which extends through both beam 33A and beam 33C. Bolt 44A has a head 44′ which is "counter sunk" into a cylindrical hole 92 of sufficiently large diameter to permit a socket wrench to engage the hexagonal head 44′ of bolt 44A and is of sufficient depth that head 44′ does not extend beyond the outer surface of beam 33C. The shaft 46 of bolt 44A extends through the lateral hole, as shown by the dotted lines in FIG. 4. A hole 93, indicated by dotted lines in FIG. 4, is drilled perpendicularly into the inner vertical surface of beam 33C, such that hole 46 extends into hole 93. (Hole 93 does not, however, extend all the way to the outer vertical surface of beam 33C). The diameter of hole 93 is sufficiently large that nut 94 can be easily threaded onto the threaded end of shaft 46 of bolt 44A. This technique of bolting the various beams and corner posts of bed unit 3 and storage unit 5 is utilized throughout and provides rigid construction without the requirement that joints be glued, and permits rapid assembly and disassembly by unskilled persons, such as the institution residents themselves. The foregoing bolting technique also allows particular joints to be loosened sufficiently to allow adding or removing desired ones of the panels without complete disassembly of either bed unit 3 or storage unit 5. After such adding or removing, the bolts can be retightened.

Referring now to FIGS. 1, 2, 2A, and 3, the construction of storage unit 5 will be described. Storage unit 5 includes four corner posts or uprights 31A, 31B, 31C, and 31D. Lower beam 33A is bolted between corner posts 31A and 31B by means of bolts 44B and 44A, respectively. An upper horizontal beam 35A is bolted to the upper ends of corner posts 31A and 31B by means of bolts 36C and 36B, respectively. A door 37 having a locking outer knob 41 and a non-locking inner knob 41A (FIG. 2), is attached to corner post 31A by means of hinges 39.

A back panel (not shown) located on the side opposite to door 37 is supported by means of grooves in corner posts 31D and 31C, into which the side edges of the back panel fit. The upper and lower edges of the back panel fit into corresponding grooves in upper beam 35E and a lower beam (not shown) which corresponds to beam 33A in FIG. 1. Thus, it is readily seen that the back panel (as well as the other panels of storage unit 5) cannot be removed without unbolting the various beams and corner posts. It should be noted that the construction of storage unit 5 is such that the nut access holes (such as nut access hole 93) in FIG. 4 in which the various nuts are positioned are all drilled from the inside faces of the respective beams and corner posts but do not extend to the outer faces of the respective beams and corner posts, so that the nuts are not visible or accessible from outside of storage unit 5, making it more difficult to burglarize storage unit 5.

End panel 38 (FIG. 1) of storage unit 5 is supported by means of longitudinal grooves located in corresponding inner surfaces of corner posts 31A and 31C and in corresponding inner grooves of lower horizontal beam 33 and upper horizontal beam 35B, which are bolted to corner posts 31A and 31C by means of bolts 36C, 31C & 44B, respectively, and a bolt on the reverse side of corner post 31C, not shown in the drawings. Thus, wall panel 38 is also unremovable without either breaking it or disassembling storage unit 5. A second end wall panel similar to wall panel 38 is designated by reference numeral 38′ in FIG. 2, and is positioned similarly in inner grooves of corner posts 31B and 31D and in inner grooves in upper and lower connecting beams 35C and 35D (FIG. 2). Front end wall panel 38′ has a hole 98 (FIG. 3) therein through which extendible (and retractable) desk unit 49 is extended or retracted.

It can be seen in FIG. 1 that beams 35A and 35E (FIG. 2) extend to the left of the vertical wall, including panel 38′, covering the general desk area into which desk unit 49 extends. A fluorescent light 45 is mounted between beams 35A and 35E. A transverse beam 35D is bolted between the left ends of beams 35A and 35E. A quarter inch thick sheet of plywood forms a top 40A (FIGS. 3 and 5), the respective edges of which are snugly disposed in corresponding grooves along the inner surfaces of beams 35A, 35B, 35C and 35D. Thus, top 40A serves as a cover over the desk area, and also serves as a theft-proof top which cannot be pried out by a prospective thief without disassembling storage unit 5. The lip provided by the portion of beams 35A–35D above the groove into which top panel 40A fits prevents items stored on top panel 40A from sliding off of the edge of storage unit 5.

A clothes pole 51 (FIGS. 3 and 5) consists of a wooden dowel or thin wall metal conduit extending between cylindrical recesses 80 in beams 35B and 35C.

Figure 3:
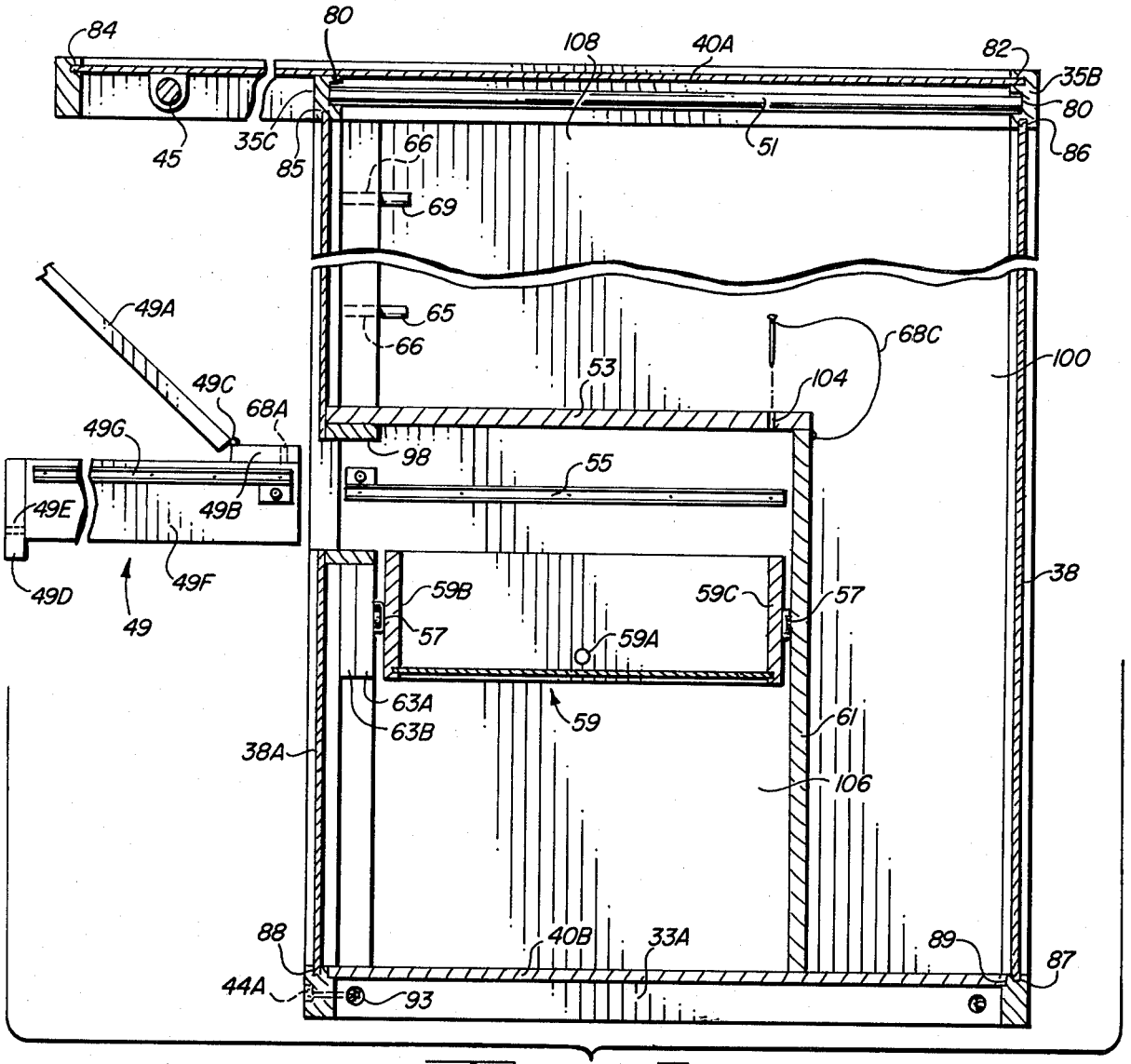
FIG. 3 is a partial vertical sectional view taken along section lines 3—3 of FIG. 1.

Referring now to FIG. 3, it can be seen that desk unit 49 includes a hinged upper work surface 49A connected to a stationary plate 49B by means of hinge 49C. A bottom compartment 49F has sides and ends to which stationary surface 49B is rigidly attached and upon which desk surface 49A rests when in the lowered position. A front 49E attached to desk unit 49 has a finger hole 49E which can be utilized (in lieu of a handle) to withdraw or extend desk unit 49 from within storage unit 5. A sliding guide rail assembly 49G is attached to either side of desk unit 49, and cooperates with a corresponding rail assembly 55 which is attached to the back side of storage unit 5. A rail assembly 49G on the opposite side of desk unit 49 is the one which cooperates with rail 55 illustrated in FIG. 3. A front plate (not shown) attached to the front end of support surface 53 and end support 61 has attached thereto a rail similar to rail 55 mating with rail 49G on desk unit 49.

When working surface 49A of desk unit 49 is lowered, and desk unit 49 is pushed or retracted or returned to its position generally indicated by region 102 in FIG. 3, a hole 104 in support surface 53 is aligned with hole 68A in desk lid 49A. A locking pin 68 (which is attached to cord 68C attached to end support 61) is then inserted in aligned holes 68A and 104, preventing desk unit 49 from being withdrawn by anyone other than the resident having a key to storage unit 5.

Still referring to FIG. 3, bench or support surface 53 is attached to corner posts 31B and 31D at its left end, its right end being supported by a three quarter inch thick plywood support panel 61. Support surface 53 can also be made of three quarter inch thick plywood. A drawer 59 which can be pulled outward through the opening of door 37 when door 37 is opened is supported by means of a pair of mating guide rails 57. A finger hole on the front panel (not shown) of drawer 59 is provided (instead of a handle) to enable a resident to pull out drawer 59. The region 106 beneath drawer 59 is useful for storing shoes, sports equipment, or other bulky possessions of the resident. The region 108 above support surface 53 can be utilized for hanging shirts and other relatively short items from clothes bar 51. The region to the right of end support 61 can be utilized to hang coats and various other long objects from clothes bar 51 and to rest long objects therein by standing them on bottom panel 40B and leaning them against the adjacent interior walls of storage unit 5.

Figure 5:
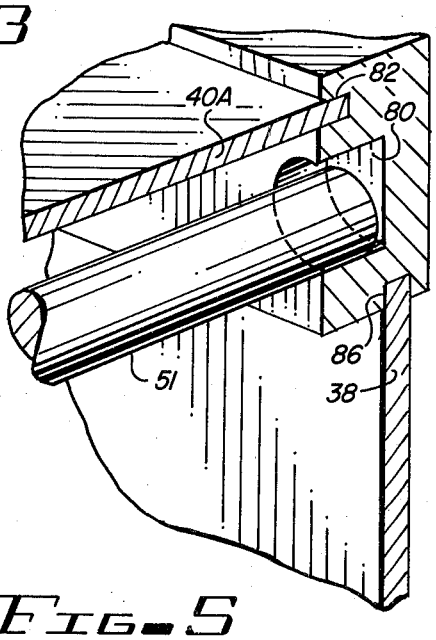
FIG. 5 is a partial perspective view useful in describing an aspect of the personal living module of FIG. 1.

FIG. 5 shows detail 5 of FIG. 3, and illustrates how clothes bar 51 is supported by cylindrical recesses 80 provided in horizontal beams 35B and 35C, respectively. (It is noteworthy that extension 56, illustrated in FIG. 1 of the floor of storage unit 5 can be provided to accommodate needs of certain individuals. For example, if module 56 is used in a nursing home for elderly persons, it might be desirable to place a portable toilet on extension 56.)

The personal module described above can be supplied in kit form by a manufacturer to adolescent group homes, child treatment centers, and the like. The assembly of the module can be incorporated into a behavior modification program designed to encourage socially appropriate behavior. It is well known that poor institutional environments (which are known to result at least partially from lack of decent living facilities) can have an adverse rather than corrective effect on the residents. This is notoriously true of certain reform schools, for example, wherein children who initially are relatively naive, both from a social point of view and a criminal point of view, become proficient criminals in a period of six to eighteen months merely by association with other residents who are more experienced and proficient in criminal behavior.

A suitable behavior modification program involves preparation of special programs for each resident, wherein various rewards are provided to reinforce socially appropriate behavior. Since the previously described poor living facilities, the resulting lack of any privacy whatsoever, and lack of private theft-proof storage space are a serious problems at such institutions, a program wherein a resident earns the various pieces of the above described living module fits very conveniently into an overall behavior modification program. For example, a resident can first earn the basic corner pieces, lower support beams and mattress support panel for the bed, whereby his mattress can be placed on the bed. Subsequent socially appropriate behavior can be rewarded by providing the end panels and side panels, thereby providing a degree of much desired privacy. By loosening the bolts of the corner posts, the newly earned side and end panels can be slipped into proper position. Later, the overhead shelf can be earned. Next, the basic framework of the storage module can be earned and assembled so that the resident has a place to store his clothes. Finally, the desk, shelves, and drawers and locking door can be earned and added, piece by piece. Later, the resident can be supplied with materials to finish the wood surface to his liking; some residents even like to carve designs in the wood corner posts.

Therapists can participate in instructing and aiding a resident in assembling the various pieces of the module as they are earned, although many adolescent residents will be able to assemble pieces as they are earned with little or no instruction other than a set of drawings which includes an identifying mark for each piece; the pieces of the kit are to be correspondingly marked by the manufacturer. The earning of and assembly of the personal module described above can greatly reduce the indifference and hostility of adolescent residents toward the furnishings of an institution if they earn and construct such furnishings, since the residents will attain a substantial degree of pride, achievement and ownership as a result of earning and constructing the above described personal living module. Further, the project described becomes an indirect vehicle for encouraging constructive interaction between a therapist and an adolescent. This is highly desirable, since such interaction frequently is strongly resisted by rebellious adolescents, who often fight against straightforward efforts to induce interaction between therapist and adolescent. As a result, the self-concept of adolescents who are involved in a program of the type described above becomes improved as he or she begins to feel trusted to perform the rather complex (to the adolescent) task of assembling his or her own personal living module.

Of course, the above described module can be utilized in other types of institutions, such as mental institutions, nursing homes for elderly persons, and prisons, with many of the above described benefits to the residents of such institutions. Further, the described storage unit will find useful application apart from the described bed unit, for example, in institutions already having beds and chairs, but not having suitable theft-proof storage space or desk area. When appropriately finished, the module may even be highly suitable for use in children's rooms in private homes.

While the invention has been described with reference to a particular embodiment thereof, those skilled in the art can readily make changes and variations in the described embodiment of the invention without departing from the true spirit and scope of the invention, as defined in the appended claims.

I claim:

1. A personal living module comprising in combination:

a. a bed, said bed having a mattress, the top of said mattress being a first height from a floor supporting said bed; and b. a storage unit for use in conjunction with said bed, said storage unit including a top, a bottom, a wall, and a door enclosing a storage region, said storage unit further including a desk unit extendible from said wall through an opening in said wall for use by a person sitting on said mattress, said desk unit being returnable into said hole to an unextended position when not in use, said desk unit having a top surface, said storage unit being positioned so that when said desk unit is fully extended from said wall, said desk unit is located a sufficient distance above and away from said mattress that an average sized person can sit at the edge of the mattress, place his or her knees comfortably beneath said desk unit and comfortably work on or study material on the top surface, a storage compartment being included in said desk unit, said top surface being hingeably connected to said storage compartment to form a cover for said storage compartment, whereby said top surface can be raised to expose said storage compartment when said desk unit is extended from said wall, wherein said door includes first locking means for locking said door, and wherein said desk unit includes second locking means for locking said desk unit in said unextended position.

2. The personal living module of claim 1 wherein said second locking means only can be unlocked from within said storage unit.

3. The personal living module of claim 1 wherein said bed unit includes a frame and removable side panel and a removable end panel each supported above a respective edge of said mattress by said frame to permit easy tucking of covers beneath said mattress beneath said end panel and said side panel.

4. The personal living module of claim 3 wherein said side panel and said end panel extend upwardly to a height sufficient to block the view of persons near said personal living module.

5. The personal living module of claim 1 wherein said bed unit and said storage unit are constructed substantially of wood and include a plurality of vertical wooden corner posts having elongated grooves therein, a plurality of horizontal wooden beams having elongated grooves therein, a plurality of plywood panels having edges fitting into particular ones of said elongated grooves, and a plurality of bolting means connecting said horizontal means to said vertical corner posts without glue, whereby assembly and disassembly of said personal living module can be performed by unskilled juveniles.

6. A storage unit for use in conjunction with a bed or chair, said storage unit including a top, a bottom, a wall, and a door enclosing a storage region, said storage unit further including a desk unit extendible from said wall through an opening in said wall for use by a person sitting on the bed or chair, said desk unit being returnable into said hole to an unextended position when not in use, said desk unit having a top surface, said storage unit being positioned so that when said desk unit is fully extended from said wall said desk unit is located a sufficient distance above and away from the chair or bed that a person of a predetermined size can sit on the chair or bed, place his or her knees comfortably beneath said desk unit and comfortably work on or study material on the top surface of said desk unit, wherein said desk unit includes a storage compartment, said top surface being hingeably connected to said storage compartment to form a cover for said storage compartment, whereby said top surface can be raised to expose said storage compartment when said desk unit is extended from said wall, wherein said door includes first locking means for locking said door, and wherein said desk unit includes second locking means for locking said desk unit in said unextended position.

7. The storage unit of claim 6 for use in a residence institution for adolescents, said locking means being actuatable to unlock said desk unit only from within said storage region, whereby said storage unit is substantially theft-proof when said door and said desk unit are locked.

8. A personal living module comprising in combination:

a. a bed, said bed having a mattress, the top of said mattress being a first height from a floor supporting said bed; and b. a storage unit for use in conjunction with said bed, said storage unit including a top, a bottom, a wall, and a door enclosing a storage region, said storage unit further including a desk unit extendible from said wall through an opening in said wall for use by a person sitting on said mattress, said desk unit being returnable into said hole to an unextended position when not in use, said desk unit having a top surface, said storage unit being positioned so that when said desk unit is fully extended from said wall, said desk unit is located a sufficient distance above and away from said mattress that an average sized person can sit at the edge of the mattress, place his or her knees comfortably beneath said desk unit and comfortably work on or study material on the top surface, wherein said door includes first locking means for locking said door, and wherein said desk unit includes second locking means for locking said desk unit in said unextended position, wherein said desk unit includes a storage compartment, said top surface being hingeably connected to said storage compartment to form a cover for said storage compartment, whereby said top surface can be raised to expose said storage compartment when said desk unit is extended from said wall, said bed unit including a frame and a removable side panel and a removable end panel each supported above a respective edge of said mattress by said frame to permit easy tucking of covers beneath said mattress beneath said end panel and said side panel, said side panel and said end panel extending upwardly to a height sufficient to block the view of persons near said personal living module, said bed unit and said storage unit being constructed substanitally entirely of wooden material and including a plurality of vertical wooden corner posts having elongated grooves therein, a plurality of horizontal wooden beams having elongated grooves therein, a plurality of panels having edges fitting into particular ones of said elongated grooves, and a plurality of bolting means connecting said horizontal means to said vertical corner posts without glue.

9. The personal living module of claim 5 wherein said storage unit includes a first storage volume extending from the bottom to the top of said storage unit for storage of long objects, said storage unit also including a second storage volume, a plurality of shelves and/or drawers being included in said second storage volume.

10. The personal living module of claim 5 wherein the nuts of said bolts in said storage unit are all located inside or beneath said storage unit to prevent loosening of said nuts from outside of said storage unit, thereby causing said storage unit to be substantially theft-proof.

11. The personal living module of claim 5 wherein said storage module includes a top ledge extending over said desk unit when said desk unit is extended for supporting a light over said extended desk unit and/or for supporting curtains on either side of said extended desk unit.

* * * * *